United States Patent [19]

Bowen

[11] Patent Number: 4,863,043

[45] Date of Patent: Sep. 5, 1989

[54] RACK FOR NECKTIES, BELTS OR OTHER APPAREL

[76] Inventor: Duane C. Bowen, 2290 Nob Hill Dr., Carlsbad, Calif. 92008

[21] Appl. No.: 157,620

[22] Filed: Feb. 19, 1988

[51] Int. Cl.[4] ..... A47F 5/08

[52] U.S. Cl. ..... 211/113; 223/85; 223/DIG. 1

[58] Field of Search ..... 211/113, 13, 45, 119; 223/DIG. 1, 85, 87, 88, 120; 248/340, 339; D6/315, 319

[56] References Cited

U.S. PATENT DOCUMENTS

| | | | |
|---|---|---|---|
| D. 175,456 | 8/1955 | Behlefeldt | D6/315 |
| 915,786 | 3/1909 | Moyer | 211/113 X |
| 3,945,500 | 3/1976 | Meckstroth | 211/13 X |
| 4,029,212 | 6/1977 | Vadiski | 223/DIG. 1 X |
| 4,593,812 | 6/1986 | Dillingham | 223/DIG. 1 X |
| 4,709,838 | 12/1987 | Campbell | 223/85 |

FOREIGN PATENT DOCUMENTS

| | | | |
|---|---|---|---|
| 146479 | 10/1950 | Australia | 223/DIG. 1 |
| 741528 | 2/1933 | France | 211/113 |
| 908114 | 4/1946 | France | 223/DIG. 1 |

*Primary Examiner*—J. Franklin Foss

*Attorney, Agent, or Firm*—Duane C. Bowen

[57] ABSTRACT

Support in a closet including a rack and a multiplicity of arms on each side of the rack for storage of neckties and belts. The rack and arms are disposed in an oblique plane preferably disposed about 30° to the vertical and slanting downwardly as it extends outwardly relative to the closet backwall to facilitate viewing of the articles, which hang from the arms in vertical planes spaced from one another. The rack is preferably supported by hanging from a clothes support rod which extends from end to end of the closet. Instead, the rack can be supported from a vertical wall or from the underside of a shelf in the closet. The support can be formed from wood, metal, plastics and/or wire. The arms are cantilevered from the rack and have abutments at their ends to prevent articles from becoming dislodged from the arms.

32 Claims, 6 Drawing Sheets

Fig. 1
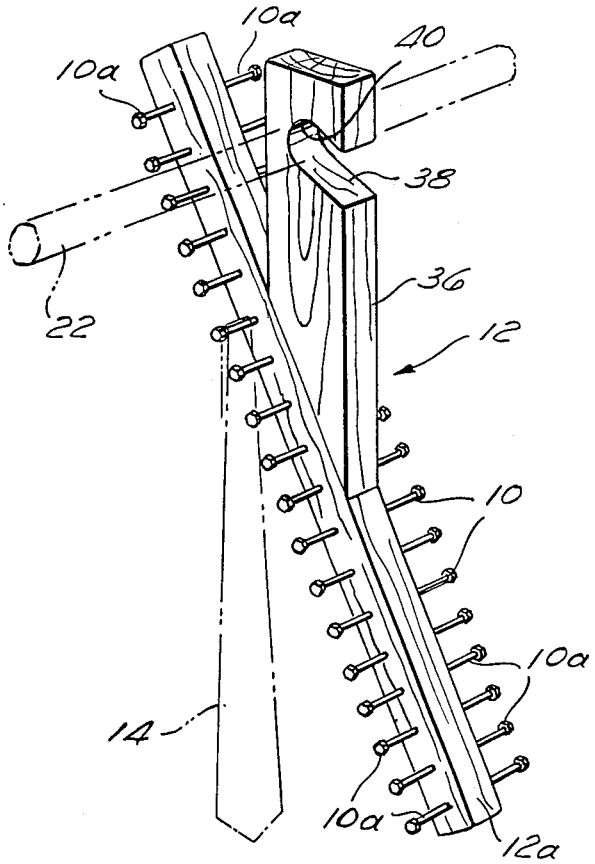
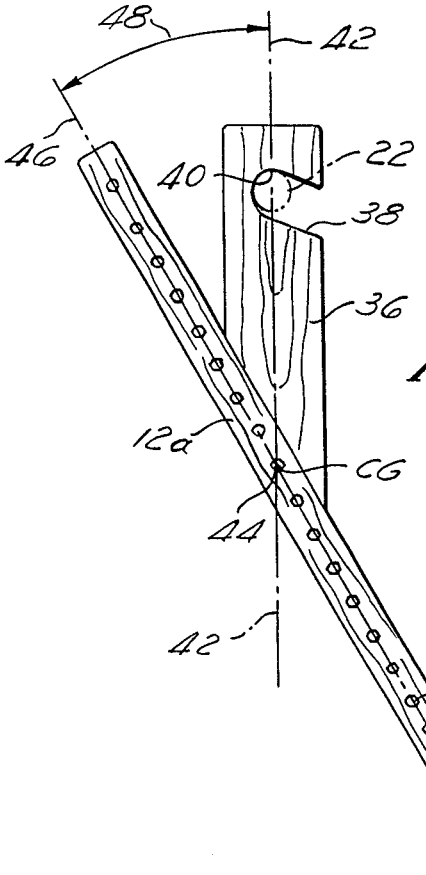
Fig. 2
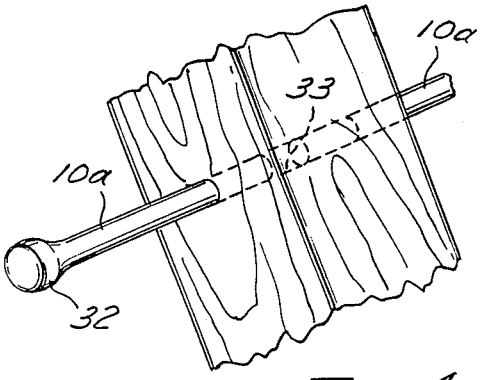
Fig. 4
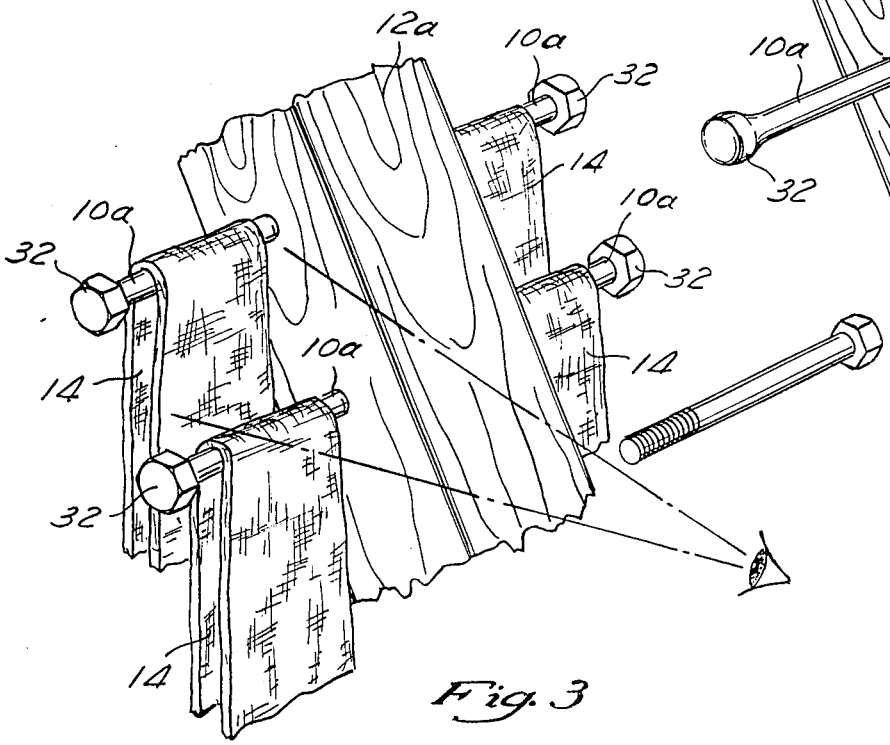
Fig. 3

Fig. 11
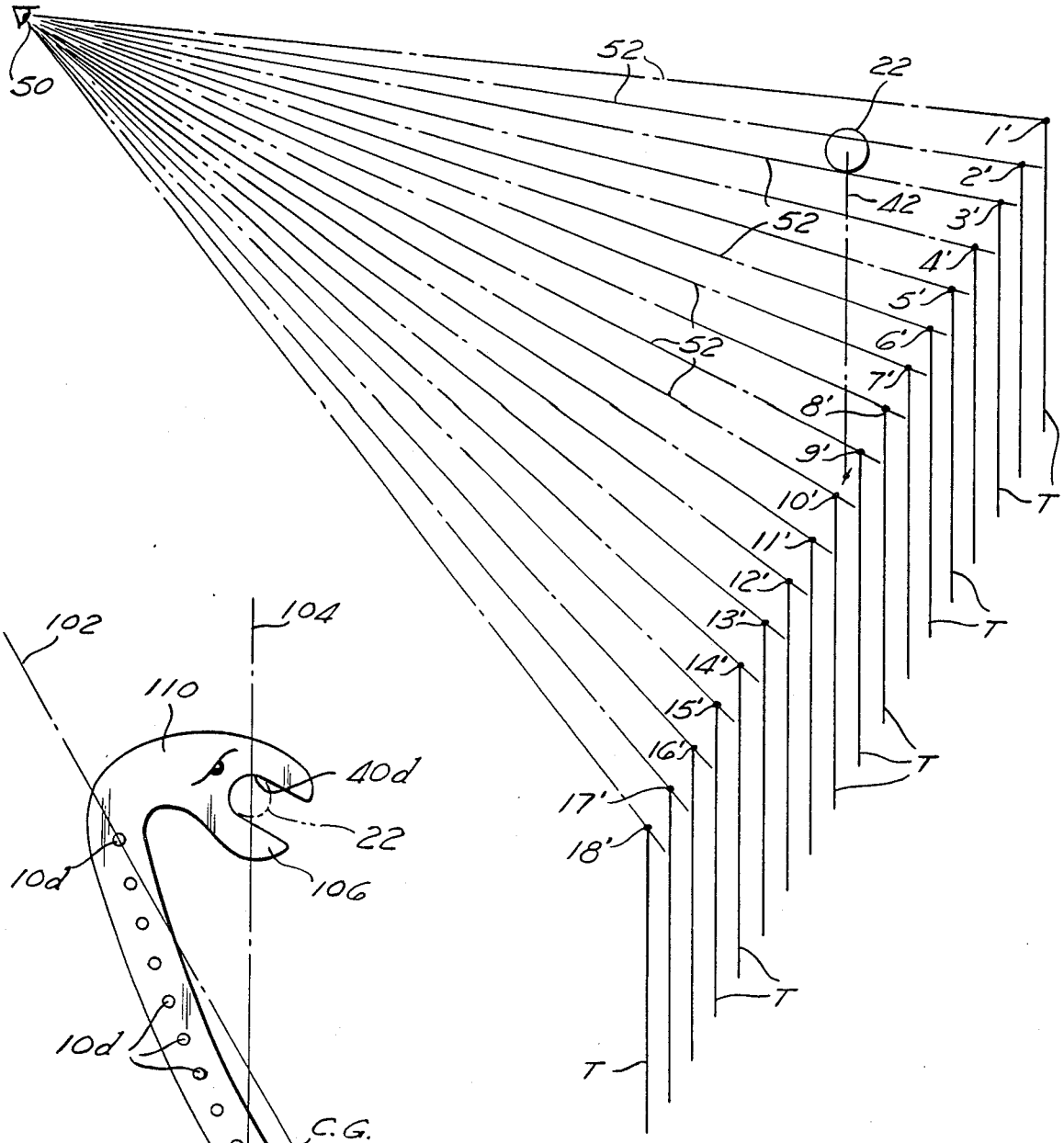
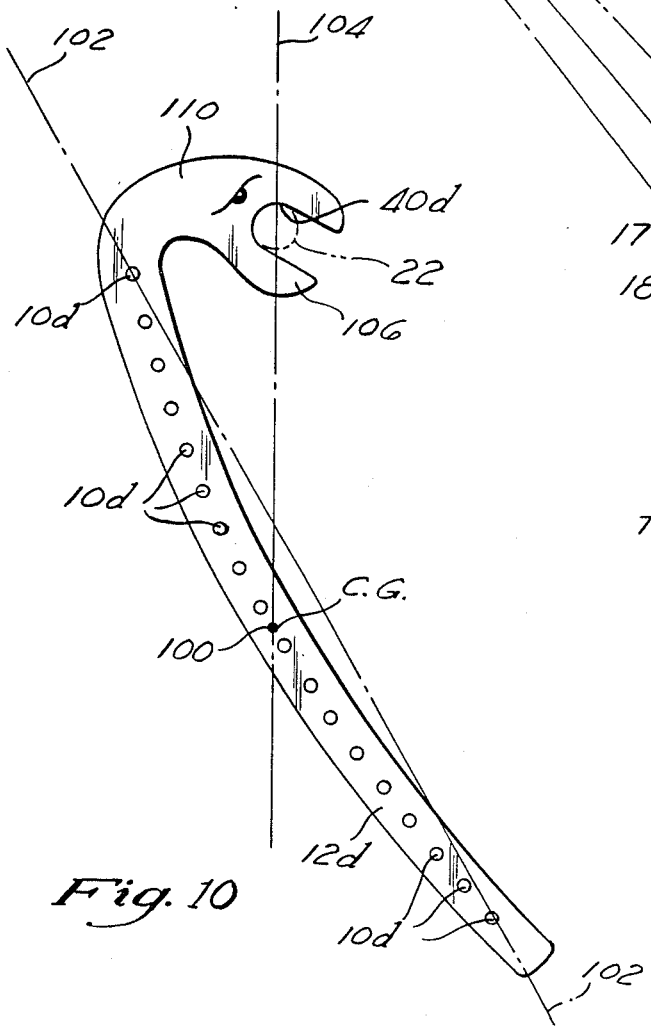
Fig. 10

RACK FOR NECKTIES, BELTS OR OTHER APPAREL

BRIEF SUMMARY OF THE INVENTION, BACKGROUND AND OBJECTIVES

My invention relates to racks for supporting particularly neckties or belts and especially in a clothes closet and preferably hung on a clothes support rod of such closet.

For some time, I have been conscious of the need for better storage of particularly neckties in clothes closets. My practice, which probably has been common to others, has been to drape the neckties over the lower horizontal bars of standard clothes hangers. This has involved several hangers with the lower horizontal bars covered in a series of layers by neckties. The result has been difficulty in viewing the neckties either to find a necktie I had in mind or to view the assortment of ties I might select from that would be of appropriate color, etc., to the other garments I was going to wear. Lighting conditions for viewing ties may be poor because of limited closet lighting, because of an overhanging shelf, and because of interference by adjacent clothing. Selection of a necktie may be made from among several dozen ties or more. Another objection to using clothes hangers for ties is the tendency when removing one necktie for one or more other ties to be pulled off the same clothes hanger and to fall on the closet floor. One objective of my invention is to devise a rack for particularly neckties that solves the problem of designing better necktie storage in especially clothes closets. A similar problem exists with belts and possibly some other apparel and it is a further objective to provide improved storage also for those items.

In thinking about the problem, I have been conscious of the difficulty of displaying several dozen ties, more or less, in the small space of a clothes closet that commonly (in the space devoted to a man's clothing) is scarcely adequate to house whirts, trousers, jackets, and suits on a clothes support rod. Not only in the space that can be devoted to ties unduly limited but also the number of objects to be displayed is quite large. A man who wears various ties as part of his work dress is likely to have at least several dozen ties and even a many who only wears ties occasionally for dress occasions may have accumulated a sizable number of ties as a result of gifts as well as purchases over the years. The need is to suitably display two, three or more dozens of neckties on a short length of clothes support rod space and it is an another objective of mu invention to meet that need.

As will be understood from the drawings and the following description, my solution to the problem of necktie storage is to support the neckties in rows, draped over arms that are parallel to the clothes support rod, the arms being at a different level for each tie in the row, the arms being disposed in a row in an oblique plane sloping downwardly as it extends toward the front of the closet, so that all ties can be viewed from the front of the closet, the rows being separated horizontally enough so that neckties in adjacent rows will not unduly interfere with each other. It is a further objective to device a rack to support and display neckties as above described.

Particularly women frequently have a similar problem in storing and displaying belts in a clothes closet and it is another objective to provide a rack that alternatively can be used to support belts particularly by engaging the arms described above with belt buckles.

In designing the rack, I was conscious of the need to provide a rack that can be manufactured and sold at a price the users would find suitable. I also knew that some buyers would want a more attractive unit although a more expensive unit, such as one displaying some handsome wood. I have conceived of wood-metal, wire, metal and plastic designs and it is an objective of my invention to provide racks at different costs and differing in design enhancements that may involve additional costs. A general objective is to minimize costs, to provide good appearance, and to maximize utility in my necktie and belt rack designs.

My invention will be best understood, together with additional advantages and objectives thereof, when read with reference to the drawings.

THE DRAWINGS

FIG. 1 is a perspective view of a specific embodiment of my new rack for neckties and belts. A clothes support rod and a necktie are shown in dashed lines.

FIG. 2 is a side view of the rack.

FIG. 3 is an enlarged partial perspective view of a portion of the rack. Arms on the rack are formed by machine bolts. Ties are shown draped over the rods. One bolt is in removed position to show the threaded end portion of the bolt. An eye of a user is indicated and dashed lines indicate the expanse of viewing of each tie.

FIG. 4 is an enlarged partial perspective view of a portion of the rack. A through bore in the rack body and a pair of bolts fitted in opposite ends of the bore as shown.

Figure 5:
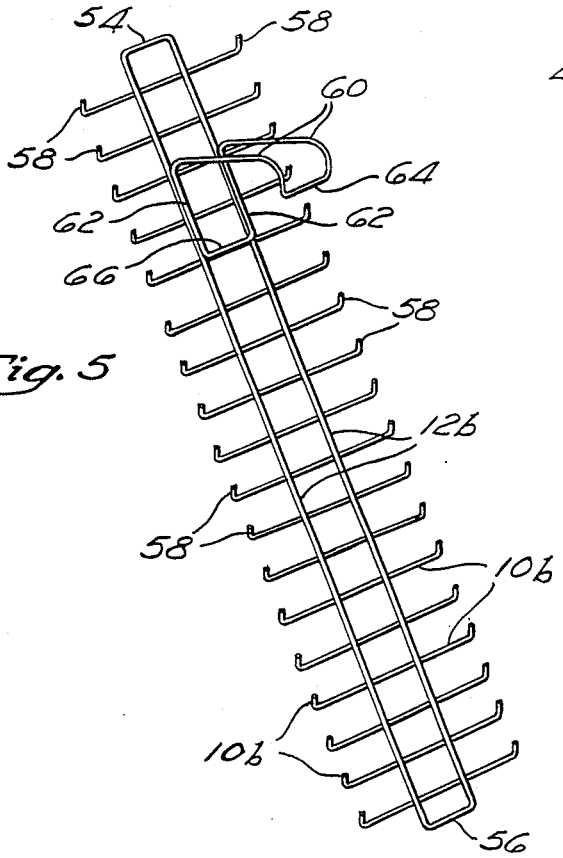

FIG. 5 is a perspective view of a modified version of the rack in which the parts are made of wire.

Figure 6:
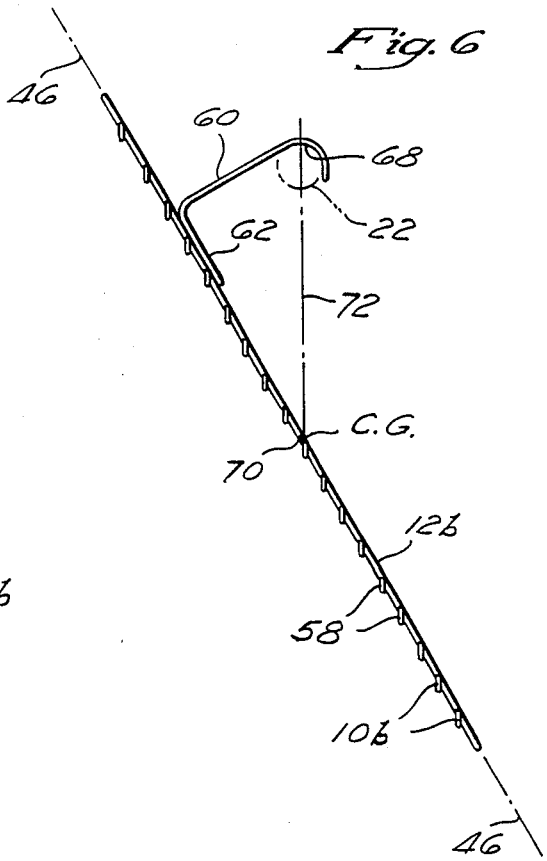

FIG. 6 is a side view of the rack shown in FIG. 5.

Figure 7:
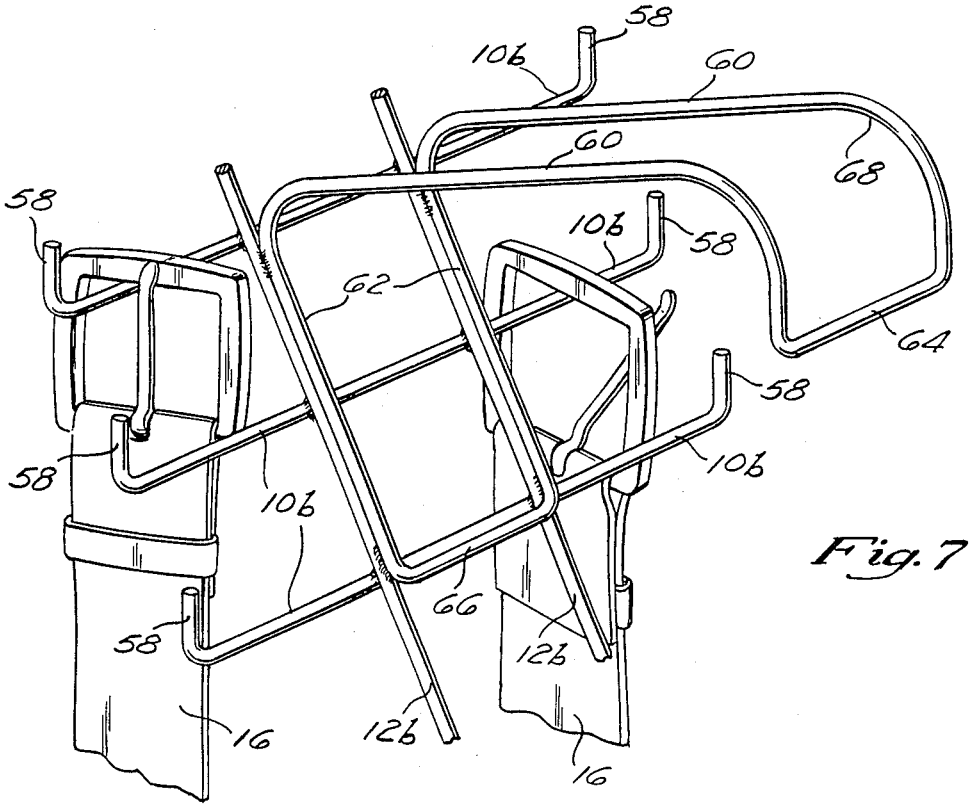

FIG. 7 is a enlarged view of the support portion of the rack formed as a bend to engage a clothes support rod in a closet. Belts are indicated supported on the arms.

Figure 8:
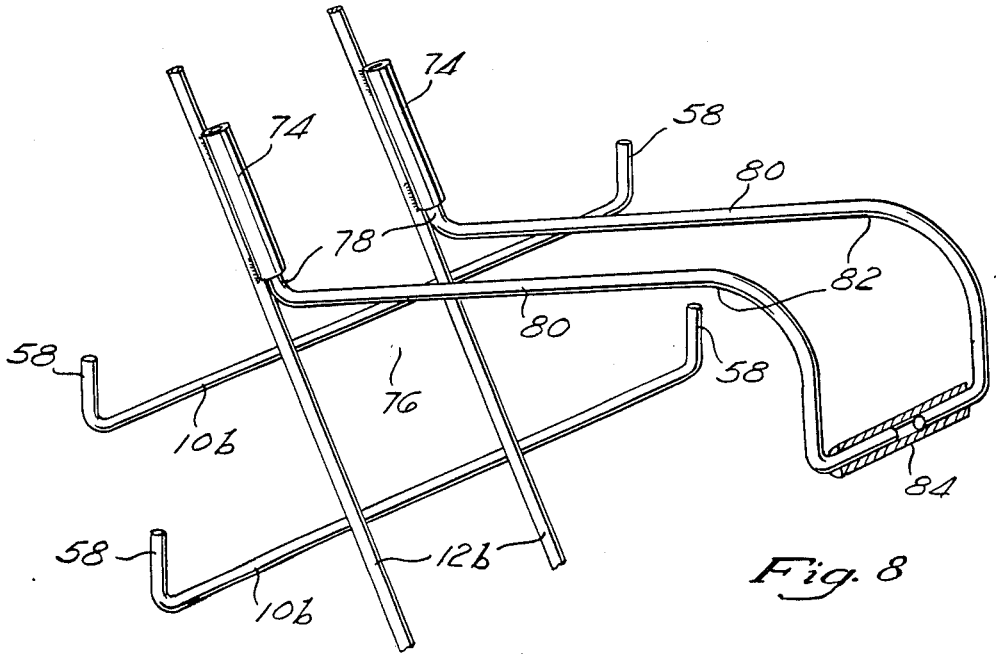

FIG. 8 is similar to FIG. 7 but shows a modified wire construction in which the support can be shipped disassembled.

Figure 9:
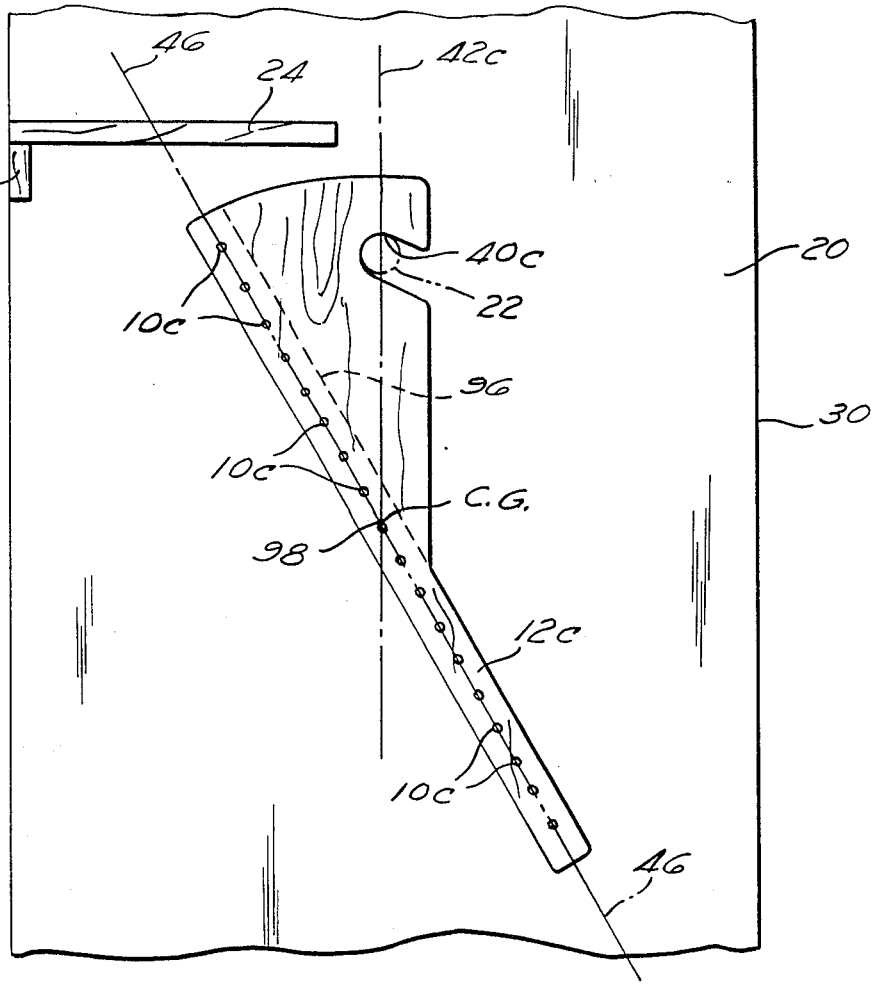

FIG. 9 is a side view of a modified version of the rack in which one piece of wood is used, whereas two pieces of wood are used in FIGS. 1–4. Front and back of a closet, a shelf and a clothes support rod are indicated to show a typical installation.

FIG. 10 is like FIG. 9 in showing a one-piece wood construction but in this case the rack is supported from the clothes support rod by a jaw-like structure at the end of a reverse bend at the upper end of the rack.

FIG. 11 is a diagrammatical view showing on the left the eye point, showing stations 1'–18' representing the locations of tie supporting arms, showing ties T depending from those arms, and having dashed lines from the eye point, past the arms, to the ties T to demonstrate how much of each tie is seen, in this representative example.

Figure 12:
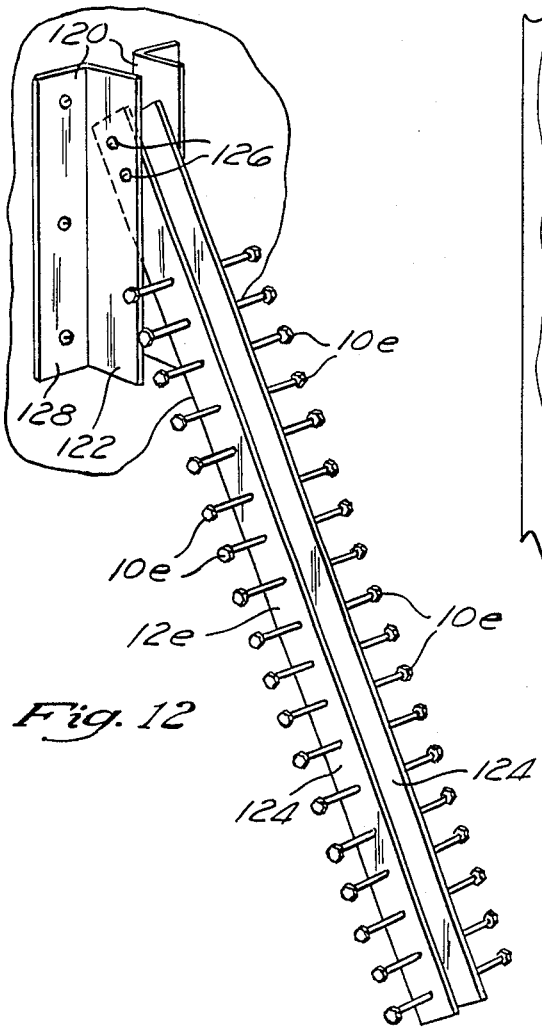

FIG. 12 is a perspective view of a modified construction in which the main structures are formed from channel and angle members. In this case a clothes support rod is not used and the angle members can be used to support the rack from a vertical surface.

Figure 13:
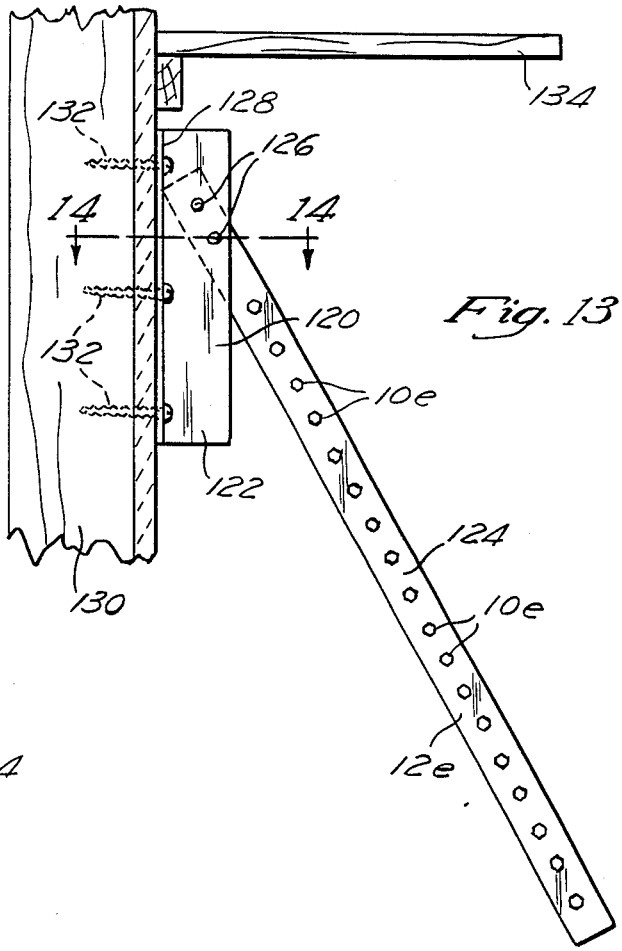

FIG. 13 is a side view of the construction shown in FIG. 12. Securing of the angles to a studding is indicated.

Figure 14:
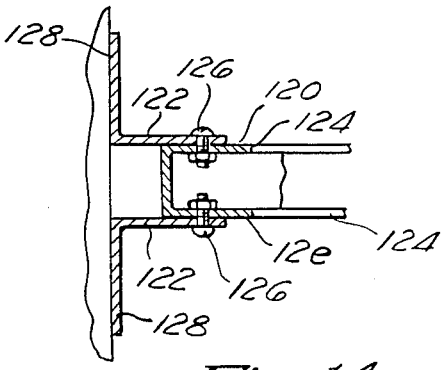

FIG. 14 is a sectional view taken on lines 14—14 of FIG. 13.

Figure 15:
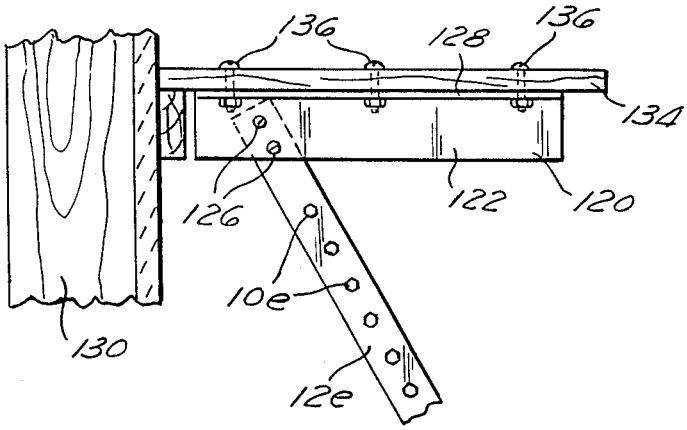

FIG. 15 is like FIG. 13 but shows the angle members being used to support the rack from the underside of a shelf.

Figure 16:
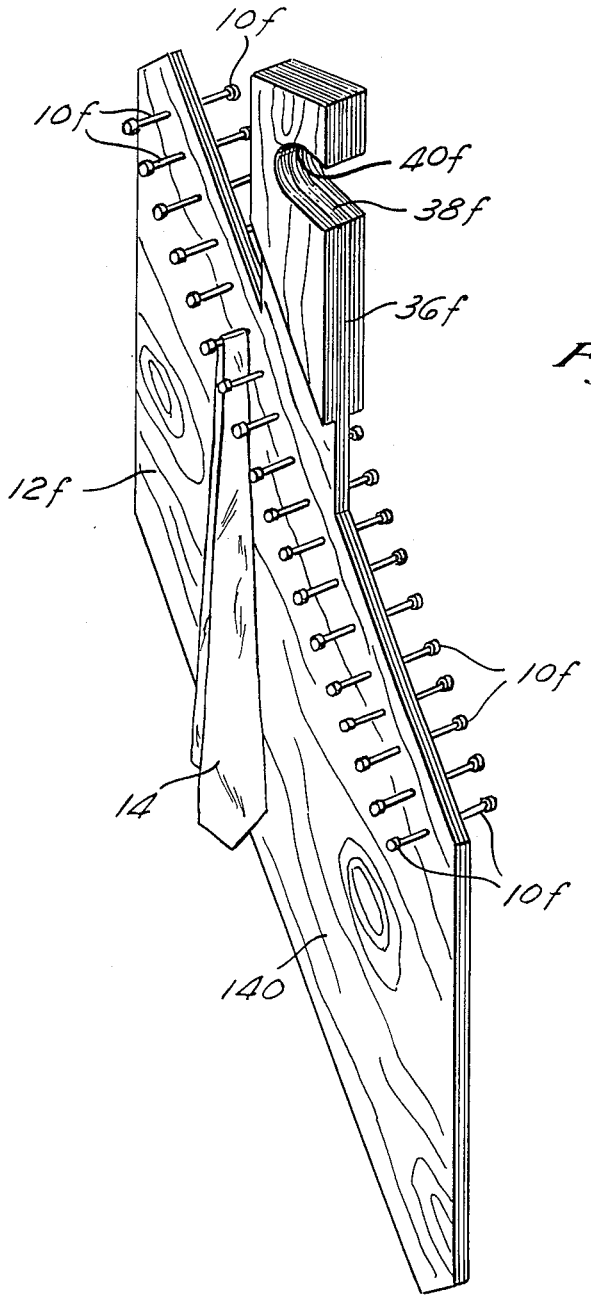

FIG. 16 is a perspective view of another modified construction.

DESCRIPTION

In the claims the term "ties" is used and is defined as including not only neckties 14 but also belts 16, because my invention is useful for storing both types of articles. The neckties 14 normally will be looped or folded neatly over the arms 10 of the rack 12 as neckties are usually formed of quite pliant fabrics that readily fold over the arms 10 and the two necktie ends depend in parallel planes from arms 10, as shown in FIGS. 1 and 3. The belts 16 commonly will be secured by threading the arms 10 of the rack into the buckles 18, as shown in FIG. 7. The belts commonly will be too stiff, although flexible, to neatly fold over the arms 10 of the rack 12. It will be understood that neckties 14 are fairly stable on arms 10 because they are so pliant, as well as being formed of fabric which has fairly high frictional properties. Belts that don't readily bend like neckties would be unstable if looped over arms 10. Some belts also have surfaces with fairly low frictional properties. I don't mean to exclude from the ambit of patent protection use of rack 12 to support other articles, particularly of apparel, such as lingerie, scarves, necklasses, etc. Again, the word "ties" is used generically to cover various articles that it may be advantageous to support and store on arms 10 on rack 12.

Usually rack 12 will be used is a closet 20 and usually rack 12 will be supported on a clothes support rod 22 extending from end to end of closet 20. Rod 22 commonly will be located at a level a little below a shelf 24 extending from end to end of closet 20 and supported at the backwall 26 of the closet by a stringer support 28 (a 1"×2", a 1"×2½". etc.) Commonly shelf 24 will be nominally 1"×12". FIG. 9 indicates typical relative dimensions and locations of closet 20, clothes support rod 22, shelf 24, closet backwall 26, and the front plane 30 of the closet which often is closed by sliding doors. In other cases, a walk-in closet is used which may be six to eight feet in depth. In any case, in most clothes storage facilitates there is a rod 22 having a location relative to a wall 26 much as is shown in FIG. 9, wherein clothes are stored on hangers in multiple parallel vertical planes perpendicular to wall 26 and to rod 22. The rod 22 often will be about 1⅜" in diameter. As will appear hereafter in connection with FIGS. 12–15, I also provide means to secure rack 12 to vertical surfaces (i.e., a closet wall) or to horizontal surfaces (i.e., the undersurface of a shelf) but it is believed in most households that the rack 12 will be best used depending from a clothes support rod 22.

In FIG. 1–4, rack **12*a* may be made from nominally 2"×2" lumber. Rack 12*a* not only supports arms 10*a* on each side but also spaces the arms 10*a* on the left from the arms 10*a* on the right so that neckties 14 on each side will not interfere too much in their lower broader parts. Arms 10*a* can be formed by plated machine bolts. A suitable size is ¼"×2½". The heads 32 can act as abutments to retain neckties 14 or belts 16 in place on arms 10*a*. Openings 34 bored in rack 12*a* (which may be through openings) may be sized to retain bolts 10*a* if they are merely pressed into place. For example, a ¼" bore may have sufficient engagement with the threads of a ¼" bolt to be retained in place without sizing requiring screwing to install or without the use of an adhesive. To simplify packaging, bolts 10*a* can be bagged and be installed by the purchaser. Bolts 10*a* should be selected with threads 34 only on their end portions. Arms 10*a* are cantilevered from opposite sides of rack 12*a***.

Arms **10*a* can be aligned at opposite sides of rack 12*a* and can be evenly spaced apart in rows. In the drawings, eighteen arms are provided in each row, which means that thirty-six neckties 14, belts 16, etc. could be supported by each rack 12*a*. If more storage is desired, two racks 12a could be used, supported side-by-side on a clothes support rod 22. If the arms 10*a* are spaced about 1⅜" on centers, then a rack 12*a* a little over two feet long has sufficient length to support thirty-six ties. At the angle to the vertical rack 12*a* is disposed in (i.e., 30°), that length of rack 12*a* will take no more depth of space than shirts, trousers and jackets on the commonly used clothes hangers. The importance will be understood (a) of being able to store as many as thirty-six articles on one rack, and (b) of requiring no more depth than other articles being hung from clothes support rods. The width of the assembly can be six inches or less, i.e., a 2"×2" is commonly actually about 1½"×1½" and the bolts 12*a* can be exposed about 2" on each side. The bolts could be 174"×2" and exposed as little as 1½" on each side, but 2" exposure is preferred. Rack 12*a*** can be made of so-called 5/4" stock (instead of so-called 2" stock) which is close to 1 3/16" in actual thickness.

A support member 36 is connected (as by screws) to rack **12*a* medially of the ends of rack 12*a*, and extends upwardly therefrom. A 2"×4" piece of lumber is suitable to form support member 36. One advantage of the construction shown in FIGS. 1–4 is that the apparatus uses some of the lowest priced lumber per square foot (2"×2"s and 2"×4"×) another advantage is that members 12*a*, 36** can be shipped disassembled for compactness in packaging, and the purchaser can connect the parts together with screws.

To engage clothes support rod 22, support 36 can have a slot 38, somewhat angled upwardly as it extends inwardly, to in effect from a hook. Slot 38 has a rest area 40 at its top adapted to extend over rod 22, thereby supporting rack **12*a* depending from rod 22**.

Considering a line 42 through the center of gravity 44 of rack **12*a* and centrally through rest 40 on top of rod 22 (FIG. 2), line 42 will be approximately vertical because the center of gravity of the combined mass of rack 12*a* and the lower part of support 36 will lie on approximately the same line 42. Then it will follow that an oblique plane 46 extending through arms 10a and rack 12*a* (see FIG. 2) will form an angle with the vertical approximately the same as with line 42. This will be the same angle as the angle between the upper part of rack 12*a* and support 36. I believe an angle of about 30° between oblique plane 46 and the vertical (and line 42) is preferable and, more generally, a minimum angle of 15° and a maximum angle of 45° are preferred limits. Note that if the angle betwen the longitudinal axis of rack 12*a* and the longitudinal axis of support 36 were changed, then the angle 48 between oblique plane 46 and the vertical would change. If support 36 were connected to a location on rack 12*a* spaced from the center of gravity 44 of rack 12*a*, then the stable position of the assembly would be with the oblique plane 46** forming a different angle to the vertical.

In my thinking about the desirable structure for a tie rack, I conceived, firstly, that rack 12 should be disposed in an oblique plane 46, and, secondly, that the particular angle 48 oblique plane 46 makes with the vertical is important in several respects: (a) in disposing ties so that numerous ties can be adequately viewed for the user to make a tie selection (for this function the steeper the angle the better), (b) so that the ties in a row will not interfere with each other so that when a tie is removed other ties are not likely to become dislodged (for this function the flatter the angle the better), (c) so that numerous ties can be displayed in the amount of closet depth normally devoted to garments hanging on hangers depending from rod 22 (for this function the steeper the angle the better), (d) recognizing that the spacing of arms 10 is related to angle 48 (the steeper the angle the closer arms 10 can be spaced), etc.

This discussion may be clarified by the diagrammatical view of FIG. 11. The location of eye viewpoint 50 relative to clothes support rod 22 in horizontal and vertical spacing is representative of the common situation in a closet installation. However, the relative heights of eye viewpoint 50 and rod 22 wil depend on the height of the person. The horizontal distance is somewhat representative of the distance from the plane 30 of the front of a typical closet to the location of rod 22 (see FIG. 9). The numerals 1′ to 18′ represent eighteen arms 10 on a rack. The vertical lines T depending from points 1′–18′ represent ties hanging from arms 10. The dashed lines 52 from eye viewpoint 50 to each tie T indicates how much of each tie can be seen. For example, the line 52 clearing the top of a rod at location 12′ indicates how much of a tie T hanging from an arm at 11′ can be seen until it is concealed by a tie T hanging on an arm at 12′. As the oblique plane 46 of rack 12 (which would be represented by a line connecting points 1′ to 18′) becomes steeper, more of each tie T can be seen; and as the oblique plane of rack 12 becomes flatter, less of each tie T can be seen. The closer points 1′–18′ are spaced, the steeper oblique plane 46 needs to be. The steeper oblique plane 46 is, the more likely removal of one tie T will dislodge an adjacent tie T. The steeper that oblique plane is, the more ties T that can be stored in the available horizontal depth of the closet.

Returning again to FIGS. 1 to 4, it is best to use a harder wood rather than a softer wood to form rack **12*a* and support 36. The structure is mostly vulnerable to breakage in the wood above slot 38, which is not only narrow but also the wood grain is extending generally vertically in the area above slot 38. Similar areas are relatively weak in FIGS. 9 and 10. Oak would be a good selection of wood, being both strong and relatively low in cost compared with some other hard woods. Fir would be a possibility among the softer woods. It will be understood, however, that the designs of FIGS. 1–4, 9 and 10** could be adapted for plastic or metal fabrication, with modifications within the skill of the art to adapted to economic manufacture with those materials.

Cantilevering of arms 10 from opposite sides of racks 12 has essential advantages compared with supports with arms 10 supported at each end: (a) the single support 12 and the cantilevered arms minimizes space required along clothes support rods 22, and (b) the cantilevered arms 10 means that neckties are "easy on, easy off"meaning that a folded necktie easily can be slipped on or off an arm 10 merely by inserting the folded necktie loop over the arm. If instead the arm were supported at each end, the ends of the necktie would have to be threaded onto the arm and removal would require lifting of the height of the folded necktie. Additionally, that procedure is more likely to move adjacent neckties than in the "easy on, easy off" cantilevered structure.

FIGS. 5, 6, 7 and 8 shows adaptation of my invention to wire fabrication. Rack **12*b* is formed of two lengths of wire of sufficient diameters to form backbones for rack 12*b*. They may be connected together at their ends 54, 56. Arms 10*b* are lengths of wire upturned at their ends at 58 to form abutments to retain ties on arms 106. Welding arms 10*b* to rack 12*b* would be a suitable securement. Ends 58 preferably are upturned at an angle that will be upright in use when rack 12*b*** is disposed in an oblique plane.

The support for rack **12*a* in FIGS. 5–7 is a doubled length of wire having sides bent into parts 60, 62 and two ends 64, 66. Side portions 62 are welded to the longitudinal wires forming rack 12*b*. Side portions 62 extends outwardly and bend to form a rest 68 that rests on the top of clothes support rod 22**.

The center of gravity 70 of rack **12*b* (FIG. 6) lies directly under rest 68 as indicated by line 72 from rest 68 to C.G. 70, which is practically vertical. The center of gravity of the whole assembly not being far from the C.G. 70 of rack 12*b*, rack 12*b* tends to hang in an oblique plane at an angle to the vertical much at the same angle as between oblique plane 46 and line 72**. Thirty degrees is preferred. An advantage of a wire construction is economy of manufacture.

FIG. 8 is modified in the manner of securing the support. A pair of tubes 74 are welded to the pair of wires **12*b* forming the rack. The support has a pair of wires 76 having first upturned ends 78 removably press fitted into tubes 74 and having second angled parts 80 that bend to form rests 82 that rest on clothes support rod 22. The ends of parts 80 are reléasably received as press fits into a connecting tube 84. The advantage of the FIG. 8 construction is that the FIG. 8** construction can be received 1n a more compact box for shipment.

The resemblance of the construction shown in FIG. 9 to the construction shown in FIGS. 1–4 will be noted. It is like the 2″×2″ and the 2″×4″ of FIG. 1 except for being sawed from one piece of wood and except the upper triangle between the 2″×2″ and the 2″×4″ if filled in with solid materials. Otherwise the two constructions act alike. This point is stressed by an imaginary dashed line 96 in FIG. 9, indicating the comparable 2″×2″ structure in FIG. 2. The rail **12*c* supporting arms 10*c* in the in the upper left portion is merely the lower side of the widened wood structure. The support engaging the clothing support rod 22 is the upper right portion. Advantages of the FIG. 9 construction include a different appeaance and less sawing, joining and finishing. Disadvantages include a wider, more expensive piece of wood must be used such as a 2″×8″ or a 2″×10″, and less compactness in shipment. If a vertical line 42*c* is drawn in FIG. 9 representing the line from the rest 40*c* to the C.G. 98 of the rail section of the object and if the oblique plane 46 of the rack 12*c* is drawn, it will be seen that the oblique plane 46** is at about 25° to the vertical.

FIG. 10 is a further derivative of the wood apparatus of FIGS. 1–4 and of FIG. 9. The rack **12*d*, preferably made of wood, is sawed from a single piece of wood, which can be a 2″×10″ (or a 5/4″×10″). Eighteen arms 10*d* are distributed along the length of rack 12*d* (formed from bolts as in FIGS. 1–4**). The C.G. of the rack portion of the product can be taken to be about at 100. Rack 12*d* is bowed (with its concave face facing to the right and somewhat upwardly) as a stylization. The support rather than attaching to the side of rack 10 instead is in the nature of a reverse bend 110 at its upper end. The oblique plane 102 extending through the end arms 10*d* can be compared to a line 104 from rest 40*d* to C.G. 100. It will be seen that rack 12*d* lies in an oblique plane and it will be seen that the oblique plane of rack 12*d* forms an angle with the vertical much like the forms of the invention previously described. It is recognized that how the assembly hangs in influenced not only by the center of gravity of its rack portion but also by the weight of other upper support sections. In the case of the FIGS. 1–4 construction, the weight of support 36 is pretty much balanced around rest 40. In the case of the wire configurations of FIGS. 5–7, unbalancing by the support structure 60, 62, 64, 66 involves only a minor weight, especially when it is considered that the rack usually will have the considerable weight of ties. In the construction of FIGS. 9 and 10, the upper portions may be a little more unbalancing but adjustment of the positions of rests 40*c* and 40*d* can be made to dispose racks 12*c* and 12*d* in desired oblique planes.

In FIG. 10, the reverse bend 110 ends in a jaw-shaped structure 106 containing rest 40*d* fitting over the upper portion of clothes support rod 22. The jaw 106 plus the bowing of rack 12*d* are somewhat suggistive of reptile or gargoyle stylization.

The modified construction shown in FIG. 12–15 uses channel and angle extrusions (metal or plastic). It can be assumed that metal extrusions are shown in these views, i.e., anodized aluminum. A 1"×1" channel is suitable for rack 12*e*. Arms 10*e* can be threaded into openings in the sides of channel 12e. Bonding can be substituted. Angle with 2" legs may be used.

The previous wood and wire forms of the invention shown in FIGS. 1-10 have been considered to hang from a clothes support rod. It would have been possible in wood or wire constructions, however, to make supports for the racks 12 which would have utilized for support a vertical structure such as a wall or a horizontal undersurface, such as the underside of a shelf, instead of depending from a rod 22 for support. In the construction shown in FIGS. 12–15 formed from extrusions, I could have adapted the assembly to hang from a rod 22. Instead, in these views I illustrate support of rack 12*e* from vertical and horizontal structures. In both cases, a pair of angle members 120 are abutted to opposite sides of the upper end of rack 12*e* and a leg 122 of each angle member is secured to a wall 124 of channel 12*e* by fasteners 126. The other legs 128 of angles 120 are secured to the vertical studding 130 by screws or nails 132 or are secured on the horizontal underside of a shelf 134 by bolts 136. Braces could be used between rack 12*e* and angles 120 to provide a more sturdy support, but they may not be needed because the weights on rack 12e are relatively low.

It will be understood that rack 12e is supported in an oblique plane, as in the case of the other racks 12. The illustration is about 30° to the vertical. The same angle members 120 can be used to secure rack 12*e* either to a horizontal or to a vertical support structure, and they can be bored appropriately to accept fasteners for either support arrangement.

The arms 10 are cantilevered from opposite sides of racks 12 and I believe it preferable that each arm have a length to support a single necktie. I recognize, however, the arms 10 could have a length to support two or even more ties on each side of rack 12. One of the virtues of the cantilevering of arms 10 is how easily ties can be put on arms 10 and taken off arms 10, i.e., a doubled tie can be merely slipped over the end of an arm 12. It is believed to be important to the workability of the invention that abutments, such as bolt heads 32 or upturned wire ends 58 be present to prevent accidental dislodgement of ties or belts. The use of as many as eighteen arms 10 on each side of rack 12 is important to minimize the length of closet space on rod 22 that is devoted to storage of ties. A minimum of ten arms 10 on each side of racks 12 is believed to be necessary to make the tie rack useful for most men in the storage of neckties.

Space on rod 22 is commonly too important to devote more space than is necessary. The width of rack 12 (in addition to having the function of strength) is used to separate rows of ties on one side from rows of ties on the other side. FIG. 16 shows one way of segregate the two rows and yet to reduce the width of the structure 12*f* serving the rack function. Rack 12*f*, support 36*f*, slot 38*f* and rest 40*f* are formed from a less thick but broader sheet, such as a plywood structure $\frac{5}{8}$" in thickness but extending as much as 12" or more below the rows of arms 10*f*, forming a skirt portion 140 to separate ties 14 on arms 10*f* on one side from ties on arms 10*f* on the other side. The function of skirt 140 could be provided in any tie support, narrow in thickness or not, extending below rack 12, i.e., a skirt 140 could even taken the form of a flexible barrier such as cloth depending from a rack 12. The upper portion of support 36*f* in FIG. 12 is shown to be reinforced by extra laminations, as compared to the remainder of the plywood sheet, because reinforcement is considered to be desirable in the vicinity of slot 38*f*.

Having thus described my invention, I do not wish to be understood as limiting myself for the exact construction shown and described. Instead, I wish to cover those modifications of my invention that will occur to those skilled in the art upon learning of my invention and which are within the proper scope thereof.

I claim:

1. Apparatus supporting a multiplicity of ties from a clothes support rod extending from side to side of a closet comprising:

(a) tie support means including a rigid, longitudinally elongated rack member having its longitudinal axis extending in a vertical plane at right angles to said rod, said rack member having on each side spaced along its length a single row composed of a multiplicity of laterally and generally horizontally extending rigid, fixed juxtaposed arms each supporting one of said ties draped over the axis of the respective arm, each arm having at its end a vertically higher abutment retaining one of said ties on the respective arm, arms in opposite rows being coaxially paired, arms in opposite rows being oppositely cantilevered outwardly from said rack member and said tie support means having only two rows of said arms, and said rack member and said rows of arms being disposed in an oblique plane, said oblique plane being disposed parallel to the longitudinal axis of said clothes support rod, and (b) a support member connected to said rack member medially of the ends of said rack member and extending upwardly therefrom and having a rest at its top adapted to extend over said rod thereby supporting said rack member depending from said rod, a line from the portion of said rest on the top of said rod to the center of gravity of said rack member being generally vertical and said line forming an acute angle with the longitudinal axis of said rack member and forming an acute angle with said oblique plane, said rack member and said rows of arms slanting downwardly in said oblique plane from back to front of said closet and each of said ties being thereby supported so that a user can see each of said ties supported on said arms when looking at said tie support means from in front thereof and from the front of said closet because said ties in adjacent arms are supported at different heights with lower arms being closer to the front of said closet, and said ties being supported in pairs in a multiplicity of spaced parallel vertical planes parallel to said longitudinal axis of said clothes support rod.

2. Apparatus supporting a multiplicity of ties from a clothes support rod extending from side to side of a closet comprising:

(a) tie support means including a rigid, longitudinall elongated rack member having its longitudinal axis extending in a vertical plane at right angles to said rod, said rack member having on each side spaced along its length a single row composed of a multiplicity of laterally and generally horizontally extending rigid, fixed, juxtaposed arms each supporting one of said ties draped over the axis of the respective arm, each arm having at its end a vertically higher abutment to retain said tie on the respective arm, arms in opposite rows being coaxially paired, arms in opposite rows being oppositely cantilevered outwardly from said rack member and said tie support means having only two paired, oppositely directed rows of said arms, and said rack member and said rows of arms being disposed in an oblique plane, said oblique plane being disposed parallel to the longitudinal axis of said clothes support rod, and (b) a support member connected to said rack member medially of the ends of said rack member and extending upwardly therefrom and having a rest at its top adapted to extend over said rod thereby supporting said rack member depending from said rod, a line from the portion of said rest on the top of said rod to the center of gravity of said rack member being generally vertical and said line forming an acute angle with the longitudinal axis of said rack member and forming an acute angle with said oblique plane, said rack member and said rows of arms slanting downwardly in said oblique plane from back to front of said closet whereby a user can see each tie supported on said arms when looking at said tie support means from in front thereof and from the front of said closet because ties on adjacent arms are supported at different heights with lower arms being closer to the front of said closet and whereby ties are supported in pairs in a multiplicity of spaced parallel vertical planes that are parallel to said longitudinal axis of said clothes support rod.

3. Apparatus supporting a multiplicity of ties from a clothes support rod in a closet, comprising:

(a) tie support means including a rigid, longitudinally elongated rack member having its longitudinal axis extending in a vertical plane at right angles to said rod, said rack member having on each side and spaced along its length a single row composed of a multiplicity of laterally and generally horizontally extending rigid, fixed, juxatposed arms each supporting one of said ties draped over the axis of the respective arm, arms in opposite rows being oppositely cantilevered outwardly from said rack member, and said tie support means having only two paired, oppositely directed rows of said arms, and said rack member and said rows of arms being disposed in an oblique plane, said oblique plane being disposed parallel to the longitudinal axis of said clothes support rod, and (b) a support member connected to said rack member and extending upwardly therefrom and having a rest at its top adapted to extend and hook over said rod thereby supporting said rack members depending from said rod, a line from the portion of said rest on the top of said rod to the center of gravity of said rack member being generally vertical and said line forming an acute angle with the longitudinal axis of said rack member and forming an acute angle with said oblique plane, said rack member and said rows of arms slanting downwardly in said oblique plane from back to front of said closet whereby a user can see each of said ties supported on said arms when looking at said tie support means from in front thereof and from the front of said closet because said ties on adjacent arms are supported at different heights with lower arms being closer to the front of said closet, and said ties being supported in pairs in a multiplicity of spaced parallel vertical planes parallel to said longitudinal axis of said clothes support rod.

4. The apparatus of claim 34 in which said rack member is supported at an angle to the vertical between 15 and 45 degrees.

5. The apparatus of claim 34 in which said rack member is supported at an angle to the vertical of 30 degrees.

6. The apparatus of claim 3 in which said rack member is a piece of lumber, said piece of lumber having parallel horizontal bores at spaced intervals and said arms being formed by bolts secured in said bores and having heads at their outer ends to retain said ties on said arms.

7. The apparatus of claim 6 in which said bores extend through said piece of lumber from side to side, said bolts being threaded and the threads holding said bolts in said bores, there being bolts on each side of each bore so that ties are supported on both sides of said piece of lumber.

8. The apparatus of claim 4 in which said rack support means is an extension at the upper end of said piece of lumber that makes a bend and said supporting surface is a clothes support rod and said bend of said piece of lumber ends in a portion extending over the top of said rod and forming a rest to seat on said rod at a point directly over the center of gravity of said apparatus.

9. The apparatus of claim 7 in which said piece of lumber is a 2×2 and said supporting surface is a clothes support rod and said rack support means being a 2×4 extending generally vertically from the center of gravity of said 2×2 and having a slot open to one side near its upper end forming a hook operative to rest on said rod to support said 2×2.

10. The apparatus of claim 3 in which said rack member includes a pair of juxtaposed longitudinal wire members and a multiplicity of transverse wire members extending laterally across said pair of longitudinal wire member with their ends extending beyond said longitudinal wire members and forming said arms.

11. The apparatus of claim 10 in which said transverse wire members have upturned ends to retain ties on said arms.

12. The apparatus of claim 10 in which said rack support means includes a pair of spaced support wires attached at their lower ends to said rack member and together forming a hook over said clothes rod resting at a point generally above said center of gravity of said apparatus and said pair of spaced support wires being connected together at their upper ends.

13. The apparatus of claim 12 in which there is a short tube secured to each of said longitudinal wire members and said lower ends of said spaced support wires being upwardly directed and removably fitting into said short tubes to secure said support wires to said longitudinal wire members.

14. The apparatus of claim 3 in which said supporting surface is a clothes support rod and in which said rack member and said rack support means are formed from a single unitary piece of material which is narrow at the first lower end of said rack member opposite to said rack support means and is broad at the second upper end of said rack member where said rack support means is located, said arms being disposed in a line close to and parallel to one side edge of said single piece of material and the other side edge of said single piece of material in said second broad end thereof having a slot open to the side which receives said rod at a location generally above the center of gravity of said apparatus.

15. The apparatus of claim 14 in which said single piece of material is a sawed unitary piece of lumber which has a row of spaced openings bored therein along its length in which one end of said arms are fitted.

16. The apparatus of claim 14 in which said single piece of material is narrow from said first lower end of said rack member to the central portion of said rack member.

17. The apparatus of claim 3 in which said supporting surface is a clothes support rod and in which said rack member and said rack support means are formed from a single unitary piece of material which is formed as a narrow length of material that is formed at its upper end with a reverse bend and a jaw-shaped rest fitting said rod.

18. The apparatus of claim 17 in which said single piece of material is a sawed unitary piece of lumber which has a row of spaced openings bored therein along its length in which one end of said arms are fitted.

19. The apparatus of claim 17 in which said narrow length of material is bowed.

20. The apparatus of claim 3 in which at least ten arms are disposed on each side of said rack member.

21. Apparatus supporting a multiplicity of ties from a clothes support rod in a closet, comprising:

(a) tie support means including a longitudinally elongated rack member having its longitudinal axis extending in a vertical plane at right angles to said rod, said rack member having on each side and spaced along its length a row composed of a multiplicity of laterally and generally horizontally extending juxtaposed arms each adapted to support a tie draped over the axis of the respective arm, arms in opposite rows being cantilevered outwardly from said rack member, and said tie support means having only two rows of said arms, and said rack member and said rows of arms being disposed in an oblique plane, said oblique plane being disposed parallel to the longitudinal axis of said clothes support rod, and (b) a support member connected to said rack member and extending upwardly therefrom and having a rest at its top adapted to extend and hook over said rod thereby supporting said rack members depending from said rod, a line from the portion of said rest on the top of said rod to the center of gravity of said rack member being generally vertical and said line forming an acute angle with the longitudinal axis of said rack member and forming an acute angle with said oblique plane, said rack member and said rows of arms slanting downwardly in said oblique plane from back to front of said closet whereby a user can see each of said ties supported on said arms when looking at said tie support means from in front thereof and from the front of said closet because said ties on adjacent arms are supported at different heights with lower arms being closer to the front of said closet and whereby ties are supported in a multiplicity of spaced parallel vertical planes that are parallel to said longitudinal axis of said clothes support rod, said acute angle being between fifteen and forty five degrees.

22. Apparatus supporting a multiplicity of ties from a clothes support rod in a closet, comprising:

(a) tie support means including a longitudinally elongated rack member having its longitudinal axis extending in a vertical plane at right angles to said rod, said rack member having on at least one side spaced along its length a row composed of a multiplicity of laterally and generally horizontally extending rigid arms each supporting one of said ties draped over the axis of the respective arm, said arms being cantilevered outwardly from said rack member and said rack member and said row of arms being disposed in an oblique plane parallel to the longitudinal axis of said clothes support rod, and (b) rack member support means including a portion extending over the top of said rod and having a rest seated on said top of said rod and supporting said rack member depending from said rest, a line from the center of said rest on said top of said rod to the center of gravity of said rack member being generally vertical and said line forming an acute angle to the longitudinal axis of said rack member and forming an acute angle with said oblique plane, said rack member and said row of arms slanting downwardly in said oblique plane from back to front of said closet and each of said ties being thereby supported to that a user can see each of said ties supported on said arms when looking at said tie support means from in front thereof and from the front of said closet because said ties on adjacent arms are supported at different heights with the lower arms being closer to the front of said closet, and said ties being supported in a multiplicity of spaced parallel vertical planes parallel to said longitudinal axis of said clothes support rod.

23. The apparatus of claim 22 in which said arms are disposed in rows on each side of said rack member, and said rack member and said support means are formed from a unitary sheet of plywood that includes a skirt portion extending below the level of said arms to segregate neckties hanging from arms on one side of said rack member from neckties hanging from arms on the other side of said rack member.

24. The apparatus of claim 22 in which said arms are disposed on each side of said rack member and there is a skirt extending from said rack member below the level of said arms to segregate neckties hanging from arms on one side of said rack member from neckties hanging from arms on the other side of said rack member.

25. Apparatus supporting a multiplicity of ties from a supporting surface, comprising:

(a) tie support means including a rigid, longitudinally elongated rack member having its longitudinal axis extending in a vertical plane, said rack member having on each side spaced along its length a row composed of a multiplicity of laterally and generally horizontally extending rigid, fixed, juxtaposed arms each supporting one of said ties draped over the axis of the respective arm, arms in opposite rows being cantilevered outwardly from said rack member, and said tie support means having only two rows of said arms, and said rack member being disposed in an oblique plane, and (b) rack member support means attached to said supporting surface and supporting said rack member so that said longitudinal axis of said rack member and said oblique plane are disposed at an angle to the vertical from 45 degrees to 15 degrees whereby a user at the end of said rack member that is lower can see each of said ties supported on its respective arm because said ties on adjacent arms are supported at different heights with the lower arms being closer to the user, and said ties being supported in amultiplicity of spaced vertical planes.

26. The apparatus of claim 25 in which said supporting surface is a clothes support rod and said rack support means includes a portion extending over the top of said rod and having a rest seated on top of said rod and supporting said rack member depending from said rest, said arms extending from both sides of said rack member in coaxial pairs.

27. The apparatus of claim 26 in which said rack support means is a member extending generally vertically from the center of gravity of said rack member and having a hook at its upper end forming said portion extending over the top of said rod.

28. The apparatus of claim 26 in which said rack support means is an extension at the upper end of said rack member that makes a bend and ends in said portion extending over the top of said rod and said rest being directly above the center of gravity of said apparatus.

29. The apparatus of claim 25 in which said supporting surface is the horizontally disposed under surface of a shelf and said rack support means includes a support attached to said under surface and to said rack member.

30. The apparatus of claim 25 in which said supporting surface is a vertically disposed household surface and said rack support means includes a support attached to said vertically disposed surface and to said rack member.

31. The apparatus of claim 25 in which said elongated tie supporting rack member is formed as a channel with a U-shaped cross-section with the legs of the cross-section disposed in vertical planes and with the base of the cross-section disposed in said oblique plane, said legs having spaced openings therealong and therebeing arms on both sides of said channel fitting into said spaced openings and secured therein, said arms being headed at their outer ends to retain ties on said arms.

32. The apparatus of claim 31 in which said rack support means includes a pair of angle shaped members each having a first leg secured to the upper end of said channel with fasteners extending through openings in said legs of said channel and positionable either in a horizontal position to secure to the under surface of a horizontal member such as a shelf or in a vertical position to secure to a vertical member such as a vertical wall, the second legs of said angle shaped members having openings to accommodate fasteners to secure to such a horizontal member or such a vertical member.

* * * * *

UNITED STATES PATENT AND TRADEMARK OFFICE

CERTIFICATE OF CORRECTION

PATENT NO. : 4,863,043

DATED : September 5, 1989

INVENTOR(S) : Duane C. Bowen

It is certified that error appears in the above—identified patent and that said Letters Patent is hereby corrected as shown below:

Column 4, line 27, '174"' should be --¼"--.

Column 10, line 34, "34" should be --3--.

Column 10, line 35 delete "is" and insert --and said rows are--.

Column 10, line 37, "34" should be --3--.

Column 10, line 38, delete "is" and insert --and said rows are--.

Column 10, line 50, "4" should be --6--.

Signed and Sealed this

Eleventh Day of September, 1990

*Attest:*

HARRY F. MANBECK, JR.

*Attesting Officer*

*Commissioner of Patents and Trademarks*